United States Patent [19]

Griesbach

[11] 4,046,039

[45] Sept. 6, 1977

[54] THICKNESS RESPONSIVE VARIABLE POSITION DIE SET

[75] Inventor: Melbourne L. Griesbach, Muskegon, Mich.

[73] Assignee: EMF, Inc., Muskegon, Mich.

[21] Appl. No.: 683,044

[22] Filed: May 5, 1976

[51] Int. Cl.[2] ..... B26D 5/06; B26D 7/26

[52] U.S. Cl. ..... 83/13; 83/368; 83/560; 83/556

[58] Field of Search ..... 83/368, 560, 556, 371, 83/13, 360

[56] References Cited

U.S. PATENT DOCUMENTS 3,555,945 1/1971 Warthen ..... 83/360 X

*Primary Examiner*—J. M. Meister

*Attorney, Agent, or Firm*—Price, Heneveld, Huizenga & Cooper

[57] ABSTRACT

A variable-position die set for trimming metal or other sheet stock to a particular length which is determined by the stock thickness, including upper and lower actuating die plates, a stationary cutting block arrangement positioned between and secured to the die plates, and a movable cutting block arrangement positioned between the die plates in spaced parallel relationship with the stationary cutting block arrangement. Stock thickness-sensing apparatus is also positioned between the lower and upper actuating die plates. Operatively associated with the sensing apparatus is a device for positioning the movable cutting block arrangement in relation to the sensed stock thickness.

25 Claims, 5 Drawing Figures

THICKNESS RESPONSIVE VARIABLE POSITION DIE SET

BACKGROUND OF THE INVENTION

This invention relates to cutting dies and more particularly to a unique variable position die set adapted for precisely cutting and trimming metal blanks subsequently wrapped to cylindrical shape.

In the manufacture of electric motor shells, it has been general industry practice to roll precut lengths of sheet metal into a cylindrical form. The ends of the rolled sheet metal are then welded. The internal diameter of the resulting cylindrical motor shell must be maintained within exact tolerances. This is necessary since it is common manufacturing practice to press fit the field laminations for the electric motors into place within the shell. If the motor shells are not formed with accurate circularity and with a constant, predetermined internal diameter, distortion of the field laminations may result. Such distortion presents variations in the air gap between the field and the rotor resulting in defective motor operation.

One apparatus and method for precisely forming cylindrical motor shells from flat blanks of sheet metal is disclosed in U.S. Pat. No. 3,732,614 to Boutell, entitled METHOD FOR MAKING MOTOR SHELLS AND THE LIKE, issued May 15, 1973, and assigned in common herewith. As shown therein, a precisely dimensioned and precision-ground forming arbor or mandrel is employed to produce the motor shells, by wrapping individual, precut lengths of sheet metal of an appropriate width around the forming arbor, using pivotally mounted jaw-like elements. Since the forming arbor has a diameter equal to the diameter of the field laminations for the electric motor, the resulting cylindrically shaped motor shell will possess the required internal diameter. Further, the shell will have accurate circularity, and therefore distortion of the field laminations of the motor is obviated. In the preferred present practice, the sheet metal blanks are precut in a cutoff and pierce die of the general type disclosed in the aforementioned U.S. patent. Although the sheet metal stock is typically supplied by its manufacturers with a specified nominal thickness, in stated ranges, the actual thickness of the individual cut blanks usually varies within the tolerances allowed by sheet metal manufacturers. In many industrial applications this variance in thickness is inconsequential and is generally ignored. However, in the manufacture of cylindrical sleeves or the like with controlled inside diameters, as in the case of motor shells, variances in the thickness of the sheet metal blanks result in changes in the internal diameter of the resulting shell if the shell is rolled so that the ends of the blank abut. This variation in the internal diameter of the shell causes serious quality control problems for their manufacturers, including a higher incidence of rejections and scrapped units as well as warranty claims for motors which fail prematurely.

If the shell manufacturer employs an apparatus of the type disclosed in the above-mentioned U.S. patent, as the thickness of the sheet stock varies the weld gap between the ends of the rolled or wrapped blank will likewise vary. For example, if the thickness of the blank is less than nominal stock thickness, the gap will decrease, and in fact it would not be unexpected for the ends of the wrapped blank to overlap, thus resulting in a defective shell. Further, if the thickness of the blank should be greater than the nominal stock thickness, the gap between the ends of the blank will increase. The increase may be sufficient to prevent effective welding of the ends of the wrapped blank. In either case, as the actual thickness of the sheet metal blanks varies from the nominal thickness, as is routinely the case, the resulting motor shell varies between two extremes, either of which is unacceptable.

A need therefore exists for an apparatus for precisely producing a sheet metal blank wherein the cut length may be varied as a function of the actual thickness of the sheet metal so that a cylinder of constant internal diameter having a constant weld gap may be produced.

SUMMARY OF THE INVENTION

A variable position die set is provided for precisely cutting metal blanks whereby the problems heretofore experienced in the manufacture of cylindrical shells from flat metal stock are substantially alleviated. Essentially, the variable position die set includes a lower actuating die plate, an upper actuating die plate superimposed on the lower die plate, a stationary cutting block arrangement fixably positioned between the die plates and a movable cutting block arrangement slidably positioned in spaced relationship from the stationary cutting arrangement between the actuating die plates. Provision is made for sensing the actual thickness of the individual, precut blanks as they are positioned between the actuating die plates and within the stationary and movable cutting block arrangements. Provisions is made for shifting the position of the movable cutting block arrangement as a function of the sensed blank thickness.

Initially, the movable cutting block arrangement is positioned so that the cut length of the flat stock is equal to pi times the sum of the desired internal diameter and the actual blank thickness. As the sensed blank thickness varies, the movable cutting block arrangement is shifted a distance equal to pi times the change in thickness. As the thickness decreases, the movable block arrangement shifts to reduce the cut length from the initial preset or nominal length. As the thickness of the stock increases, the movable cutting block arrangement shifts so that the cutting length is greater than the nominal length.

Therefore, the variable position die set in accordance with the present invention is capable of precisely cutting metal blanks which may be subsequently formed into cylindrical shells having an internal diameter maintained within precise tolerances and a precisely dimensioned welding gap.

DETAILED DESCRIPTION OF THE PREFERRED EMBODIMENT

Figure 1:
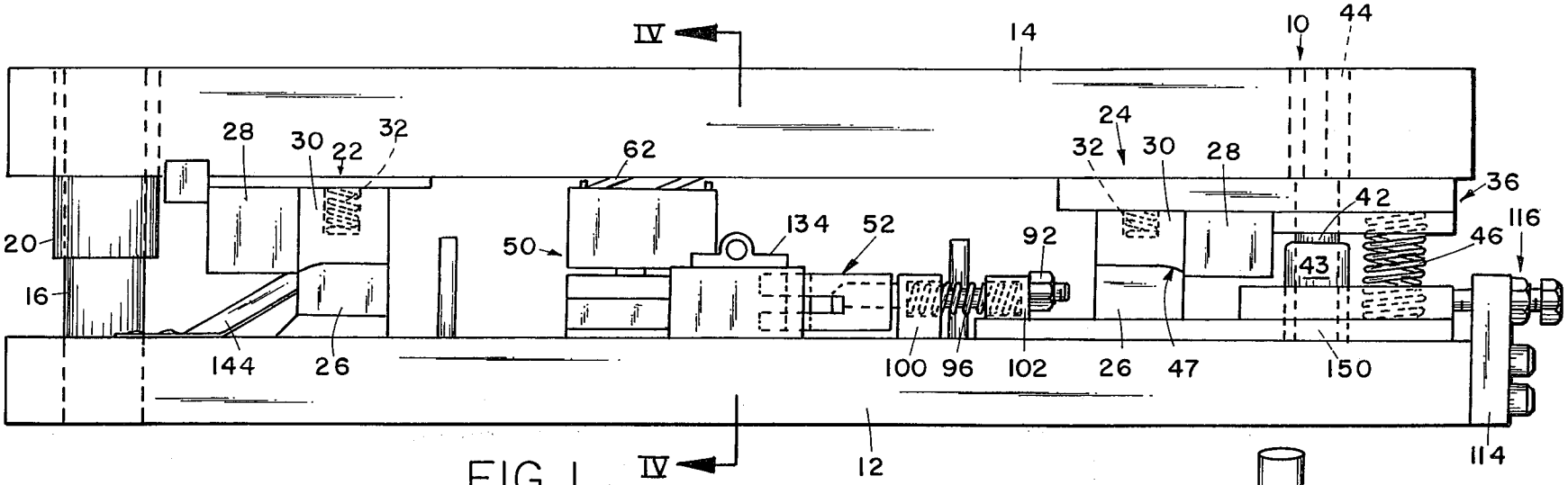
FIG. 1 is a front, elevational view of a variable position die set in accordance with the present invention.
Figure 2:
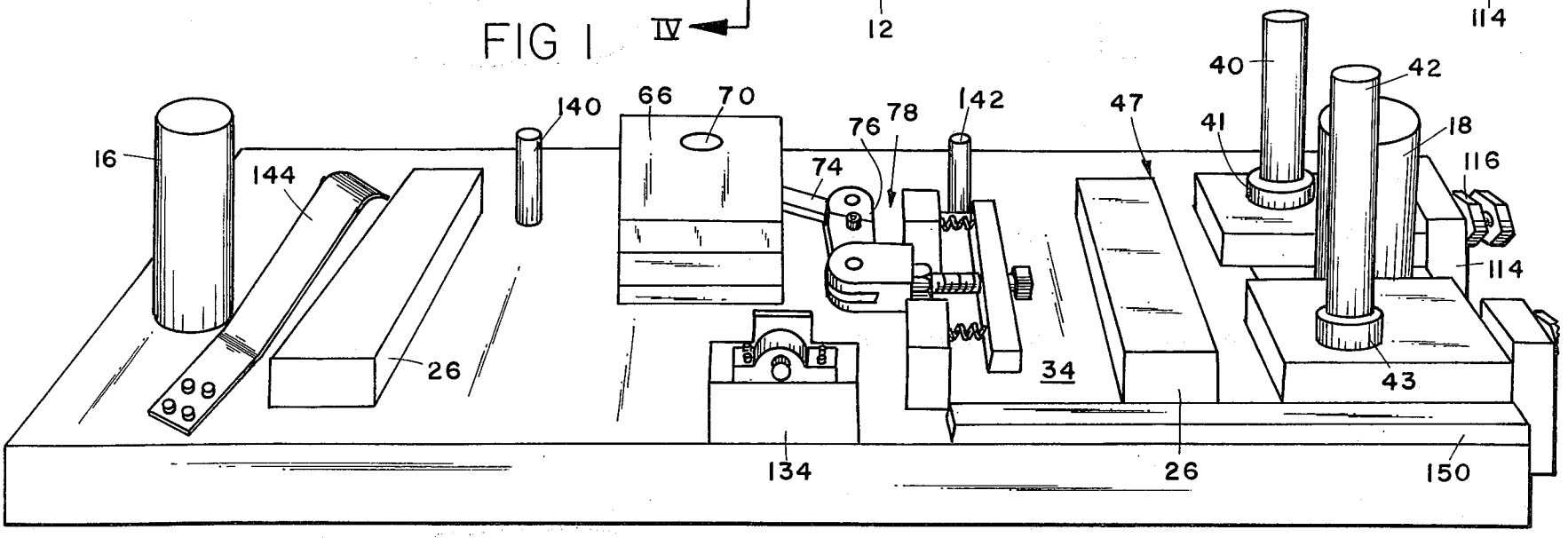
FIG. 2 is a perspective view of the variable position die set shown with the upper actuating plate removed.

The preferred embodiment of the variable position die set in accordance with the present invention is illustrated in the drawings and generally designated 10. As shown in FIGS. 1 and 2, the die set includes a lower actuating die plate 12 and an upper actuating die plate 14. Plate 14 is superimposed on plate 12. A pair of centrally positioned, spaced guide pins or posts 16, 18 extend upwardly from the lower plate 12 through apertures formed in the upper plate 14. Suitable sleeves 20 may be received within apertures formed in the upper actuating die plate 14 to provide a guide structure. The upper actuating die plate 14 is therefore mounted for vertical motion relative to the lower actuting die plate 12.

Positioned between the die plates 12 and 14 so as to be actuated thereby are a stationary cutting block assembly 22 and a movable cutting block assembly 24. Each cutting block arrangement 22, 24 includes shearing blocks 26, 28 and a vertically movable forming (or preforming) block 30 suspended and preloaded by springs 32.

With stationary assembly 22, the shearing block 26 is fixed to the lower die 12. The movable forming block 30 is suspended from the upper plate 14 in direct vertical alignment with the fixed block 26. The shearing block 28 is fixedly secured to the upper plate 14 adjacent to and in sliding contact with the movable forming block 30.

The laterally shiftable or variable position cutting block assembly 24 has the lower fixed shearing block 26 fixedly secured to lower inner die plate 34 while the vertically movable forming block 30 and the fixed upper shearing block 28 are secured to an upper, inner die plate 36.

The inner die plates 34, and 36 are mounted between the actuating die plates 12, 14 for limited, longitudinal movement. As best seen in FIGS. 1 and 2, a pair of transversely spaced guide pins 40, 42 extend upwardly through guides 41, 43 in the lower inner die plate 34 and pass through guides in the upper inner die plate 36 and through slots the upper actuating die plate 14. As a result, the lower inner plate 34 may be shifted either to the right or to the left as viewed in FIG. 1. The pins maintain the vertical alignment between the various cutting blocks of the shiftable assembly 24. As shown in FIG. 1, a pair of coil springs 46 may be positioned between the plates 34, 36. These coil springs open the cutting block arrangement after the cutting operation.

As best seen in FIG. 1, the shiftable forming blocks 30 and the fixed lower shearing blocks 26 may be relieved or varied in thickness along a radius of curvature at their cutting or shearing edges 47. This radius of curavature may approximate that of a wrapping arbor or mandrel if the precision cut sheet metal blanks are to be wrapped in a cylindrical form. When a sheet metal blank is placed within the die arrangement and the upper die plate 14 is moved downwardly towards the lower die plate 12 the springs 32 are compressed and the shiftable upper blocks 30 will grip the sheet stock against the lower blocks 26. Upon further downward movement of the upper plate 14, the shearing blocks 28 and 26 will shear or cut the sheet metal blank. During the shearing step, the sheet of stock becomes bent downwardly along the edge by the lip of forming block 30. Bending of the sheet stock will typically occur after the shearing, and the edges of the sheared stock will therefore be severed at right angles. However, when the sheet stock is wrapped about the forming arbor, the free end of the blank will define an outwardly-widening V-shaped configuration suitable for the welding process. The forming of the edges eliminates an undesirable "roof" effect upon wrapping of the blank because of the inability of clamping the systems marginal edges.

As previously set forth, in order for a cylindrical shell to be efficiently formed on a mass-produced basis wherein each shell has a constant internal diameter or the gap between the free edges of the blank upon wrapping remains constant, the cut length of the sheet must be varied as a function of the thickness of the sheet. The cut length L will be equal to the internal circumference of the resulting cylinder plus pi times the thickness T of the sheet. Since the internal circumference of the cylinder must be capable of receiving a particular size of electric motor, having a given external diameter D, the cut length may be defined by the following equation:

$$L = \pi (D + T)$$

Since the initial thickness $T$ of any sheet metal stock will vary and the internal circumference of the resultant shell must be maintained constant, the relationship between the initial cut length $L$ and subsequent cut lengths may be defined as follows:

$$L_2 = L + \pi \Delta T,$$

where $\Delta T$ equals the change in thickness between the different blanks.

Therefore, in order to obtain proper results provision must be made for shifting of the die set 24 a distance proportional to pi times the change in thickness of subsequent sheets. One such arrangement is illustrated in the drawings as including a mechanical sheet-thickness sensing arrangement 50 and a pi-multiplier 51 (FIG. 1).

Figure 3:
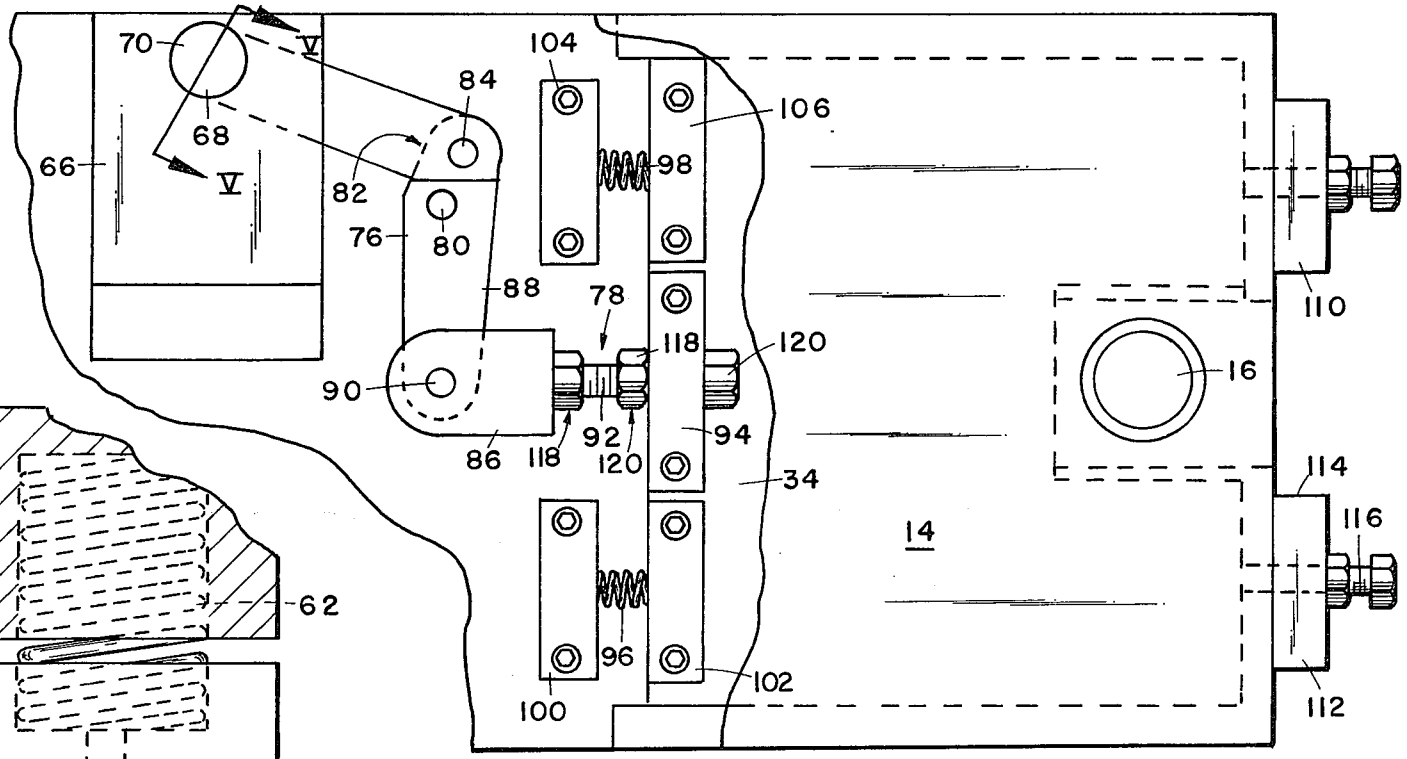
FIG. 3 is a fragmentary plan view of the variable position die set shown with portions of the upper plate removed.
Figure 5:
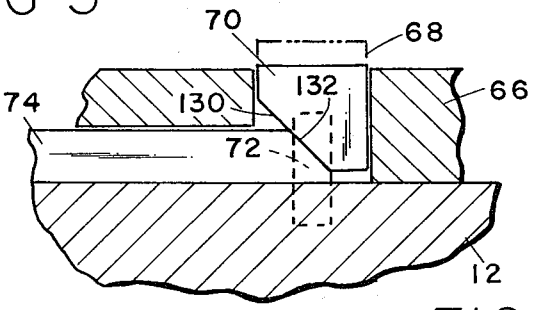
FIG. 5 is a fragmentary, cross-sectional, elevational view taken generally through section line V—V of FIG. 3.
Figure 4:
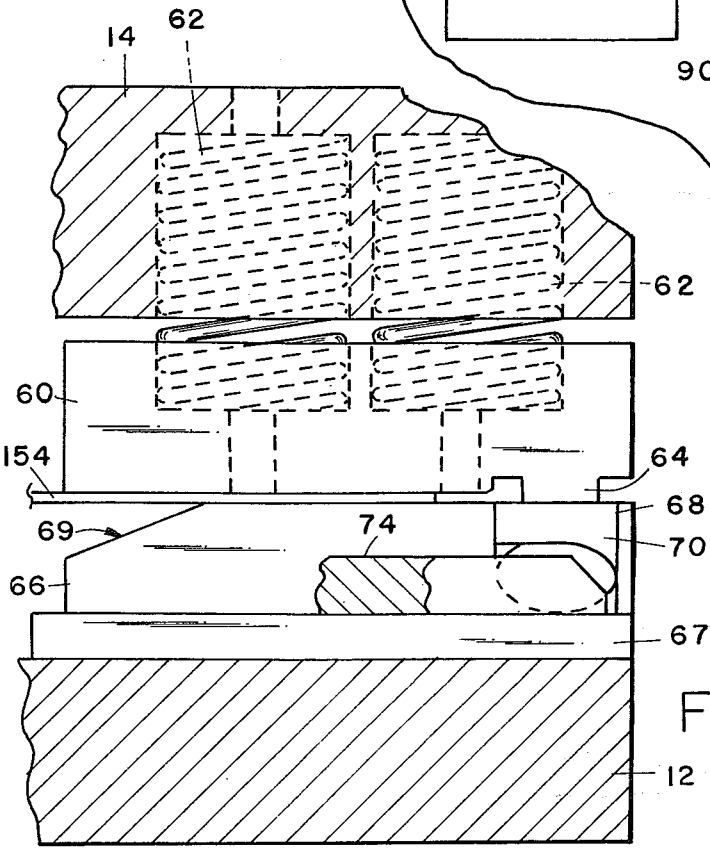
FIG. 4 is a fragmentary cross-sectional elevational view taken generally through section line IV—IV of FIG. 1.

As best seen in FIG. 4, the thickness sensor assembly 50 includes a spring-loaded sensor block 60 suspended from the upper actuating die plate 14 and preloaded by a pair of coil springs, or the like, 62. Intermediate the sides of the sensor block and adjacent the trailing edge thereof, the block includes a depending finger or projection 64. Mounted directly below the sensor block 60 is a sensor base block 66. The base block 66 is secured to a plate 67 which in turn is secured to the lower actuating die plate 12. The face 69 of base block 66 is angled to assist in placement of a blank within the die. As best seen in FIGS. 3 and 5, directly below the depending finger 64, the base block 66 is formed with a bore 68 within which is disposed a sensor pad 70 which is mounted within the bore for vertical movement by a locator pin and coil spring 72 (FIG. 5).

The pi multiplier 52 includes a cam link rod 74, a bell crank or lever 76, and a die set push arm assembly 78. The bell crank 76 is pivotally mounted to the lower actuating die plate 12 by a pin 80. The cam link rod 74 is pivotally secured to the short arm 82 of the bell crank by a pin assembly 84. The die set push arm assembly 78 includes a thrust block 86 pivotally secured to the end of the long arm 88 of the bell crank by a pin assembly 90. A thrust bolt 92 is secured to the thrust block 86 and extends through an aperture formed in a retainer block 94. The retainer block 94 is fixedly secured to the lower shiftable die plate 34 of assembly 24 (FIGS. 1 and 3). A pair of shiftable die assembly return springs 96, 98 are positioned between retainer blocks 100, 102 and 104,

106, respectively. The spring retainer blocks 100 and 104 are fixedly secured to the lower actuating die plate 12 while the retainer blocks 102, 106 are fixedly secured to the shiftable die plate 34. These return springs serve to bias the variable position or movable die assembly 24 against a pair of stop block assemblies 110, 112. As best seen in FIGS. 1 and 3, the stop block assemblies include upstanding blocks 114, each having an internally threaded aperture for receiving an adjustment bolt and stop nut 116. It should also be noted that a pair of adjustment nuts 118, 120 are threadably received on thrust bolt 92 of the die set push arm assembly 78, on opposite sides of retainer block 94. As a result of this arrangement, the initial positioning of the shiftable die assembly 24 may be set by adjustment of the stop bolt assemblies 116 and the adjustment nuts 118, 120 on the thrust bolt 92.

As best seen in FIG. 5, the lower end 130 of the sensor pad 70 is beveled along an angle of 45°. This beveled edge defines a camming surface which meets with or engages a cam follower surface 132 on the cam link rod 74. The cam follower surface 132 is also cut along an angle of 45°. As a result, there is a one-to-one correspondence between the movement of the sensor block and the movement of the cam link rod 74 when the thickness-sensing assembly is pressed down on a sheet metal blank.

The bell crank 76 is dimensioned so that any change in the sensed thickness of each sheet metal blank will result in a shift in the position of the variable position die set 24 equal to pi times the change in thickness. This shift in position is readily obtained by making the bell crank 76 so that the ratio of the length of the short arm 82 over the length of the long arm 88 is equal to the reciprocal of pi.

As best seen in FIGS. 1 and 2, back stops 140, 142 are provided adjacent the rear edge of the lower actuating die plate 12. Further, a leaf spring type stop or edge guide 144 is secured to the lower actuating die plate 12 adjacent the fixed shearing block 26. Also, gibs or slide track ways 150, 152 may be positioned adjacent the lateral edges of the lower plate 12 to slidably receive the variable position, lower die plate 34. A front stop 134 (FIG. 2) is provided to insure proper positioning of each blank within the die assembly. The back stops 140, 142, edge guide 144 and front stop 134 fixably position the blanks within the die arrangement.

The mode of operation of the above described arrangement will now be more fully discussed. If the die set is to be employed in the manufacture of electric motor shells, the sheet stock is initially precut to the desired width and preferably to a length equal to the product of the constant pi times the sum of the diameter of the motor and the maximum stock thickness, plus four times the maximum stock thickness. Such precut lengths insure sufficient material for the final trimming operation in the variable position die set and reduce the amount of unnecessary material waste. Next, one of the precut blanks is positioned within the die set and between the shearing blocks. The blank is pushed forward until it abuts the back stops 140, 142. The sensor block base 66 is beveled along its forward edge for ease of insertion of the blank. Also, blanks for use in forming motor shells may be prepunched at various locations. Pilot pins or locating pins may be positioned on the lower actuating die plate 12 to assist in locating the blank within the die set. The thickness of the first sheet is determined and the variable-position cutting block arrangement 24 is positioned so that the desired wrapped dimensions will be obtained. This positioning is accomplished through the adjustment nuts 118, 120 provided on the trust bolt and also through positioning of the end stop bolts. The actuating dies may then be pressed together thereby severing and preforming the edges of the blank.

As subsequent precut blanks are positioned within the die set arrangement, and the upper actuating die plate is pressed down toward the lower die 12, the sensing block 60 will initially contact the blank 154, as shown in FIG. 4. Depending finger 64 will then contact the sensor pad 70 and force the pad 70 downwardly an amount dependent upon the change in the thickness of the blank from the initial preset position. Movement of the sensor pad 70 will be transmitted through the cam link rod 74 to the bell crank 76. As a result, the bell crank 76 will move the lower die plate 34 a distance equal to pi times the change in sensed blank thickness.

As will be readily apparent to those skilled in the pertinent art, various modifications may be made to the die set as described and illustrated. For example, other forms of pi multipliers may be employed to obtain the desired positioning of the variable die structure. Such arrangements could be electrical, hydraulic or other forms of mechanical linkages. Also, the present arrangement may be adapted to vary the cut length as a function of thickness other than by positioning in a manner proportional to pi. The sensing and shifting arrangement are adaptable to any use wherein the ultimate cut length of a sheet should be made dependent upon the thickness in some proportional relationship.

When the apparatus is employed for precision trimming of blanks which are subsequently rolled or wrapped into a cylindrical configuration as in the manufacture of motor shells, the resultant shell will have a constant internal diameter and/or a constant gap between the adjoining edges of the wrapped blank. As a result, the quality control involved in this manufacturing process is substantially increased. The resulting welds which bond the joining edges of the blank may be of uniform quality since the gap will be maintained constant. Also, since the internal diameter may be directly controlled in this manner any distortion to the motor field laminations subsequently press fit into the shell will be avoided. It can, therefore, be seen that the problems heretofore experienced by prior art methods and apparatus have been substantially alleviated by the present invention. It is expressly intended, therefore, that the above description be considered as that of the preferred embodiment only. The true spirit and scope of the present invention should be determined by contemplation of its underlying concept, and by reference to the appended claims.

The embodiments of the invention in which an exclusive property or privilege is claimed are defined as follows:

1. A variable-position die set adapted for precisely cutting sheet stock to a specified size as a function of blank thickness, comprising:

a first actuating die plate;

a second actuating die plate superimposed on said first die plate in a spaced, vertical relationship therewith;

a shiftable cutting means positioned between said die plates for severing the edge of the stock upon closing movement of said actuating die plates;

means operatively coupled to said die plates for sensing the thickness of the blank; and means operatively associated with said sensing means for shifting said cutting means a distance proportional to the sensed thickness of the stock prior to severing of the edge by said cutting means.

2. A variable-position die set as defined by claim 1, further including:

a stationary cutting means secured to said actuating die plates in spaced relationship with said shiftable cutting means for severing another edge of said stock upon closing movement of said actuating die plates.

3. A variable-position die set as defined by claim 1 wherein said sensing means comprises:

a sensor base block secured to one of said actuating die plates;

a sensor block secured to the other actuating die plate for limited movement relative thereto;

a resilient biasing means acting on said sensor block; and a sensor pad carried by said base block operatively associated with said means for shifting, whereby upon closing movement of said actuating die plates said sensor block engages said sheet stock and positions said sensor pad as a function of sheet stock sensed thickness prior to the severing action of said shiftable cutting means.

4. A variable position die set as defined by claim 3 wherein said shifting means includes:

a cam member positioned by said sensor pad;

a push arm assembly connected to said laterally shiftable cutting means; and multiplier means operatively coupled to said cam member and said push arm assembly for varying the position of said shiftable cutting means a distance proportional to the thickness of the sheet stock positioned within the die set in response to the position of said cam.

5. A variable position die set as defined by claim 4 wherein said sensor pad includes a cam surface beveled at an angle of 45° and said cam member includes a cam follower surface engaged by said cam surface and also beveled at an angle of 45°.

6. A variable position die set as defined by claim 4 wherein said multiplier means comprises:

a lever means pivotally mounted on one of said actuating die plates, said cam member acting on one end of said lever means and said push arm assembly acting on the other end thereof.

7. A variable position die set as defined by claim 6 wherein said lever means has an arm on each side of its pivot mount and said arms are of unequal length, said cam member acting on the short arm and said push arm assembly acting on said long arm.

8. A variable position die set as defined by claim 7 wherein the ratio of the length of said short arm to the length of said long arm is equal to the reciprocal of pi.

9. A variable position die set as defined by claim 8 wherein said shiftable cutting means comprises:

an inner plate slidably mounted on one of said actuating die plates and connected to said push arm assembly;

a first shearing block secured to said slidably mounted plate;

a second shearing block; and means for positioning said second shearing block above said first shearing block and for causing said shearing blocks to move toward one another upon closing movement of said actuating die plates.

10. A variable position die set as defined by claim 9 wherein said push arm assembly includes means for adjusting the initial position of said inner plate.

11. A variable position die set as defined by claim 10 further including:

a stationary cutting means secured to said actuating die plates in spaced relationship with said movable cutting means for severing the edge of the stock opposite said shiftable cutting means upon closing movement of said actuating die plates.

12. A method of trimming precut lengths of basically flat sheet stock, comprising the steps of:

placing a first length of said stock in a cutting die so that said stock is generally positioned to be cut along one edge thereof by said die;

sensing the thickness of said stock prior to actuation of said cutting die;

shifting the position of said cutting die relative to said stock a distance proportional to the sensed thickness of said stock; and actuating said cutting die to thereby trim the edge of said stock, whereby the trimmed length of said stock has a predetermined relation to the sensed thickness.

13. A method of trimming precut lengths of flat sheet stock as defined by claim 12 further comprising the steps of removing the trimmed first precut length of stock from said die;

inserting a second precut length of stock within said die;

sensing the difference in the thickness between said first precut length and said second precut length;

varying the position of said cutting die a distance proportional to the sensed difference in thickness;

actuating said cutting die to thereby trim the edge of said second length of stock.

14. A method as defined by claim 13 wherein the position of said cutting die is varied a distance equal to pi times the sensed change in thickness.

15. A device for sensing the thickness of a fixedly positioned flat sheet of stock and positioning a cutting arrangement relative to said stock comprising:

an upper plate;

a lower plate;

means mounting said plates in superimposed relationship for relative, closing motion toward one another;

a sensing block mounted for limited movement relative to said upper plate;

a spring disposed between said sensing block and said upper plate for biasing said sensing block towards said lower plate;

a sensor base block secured to said lower plate in vertical alignment with said sensing block, said base block having a recess therein, and said sensing block including a depending projection in alignment with said recess;

a sensor pad movably disposed in said recess so as to be engaged and moved by said projection upon closing movement of said plates, the amount of movement of said pad being dependent upon the thickness of the stock; and means operatively associated with said sensor pad for shifting the position of the cutting arrangement relative to the stock a distance proportional to the sensed stock thickness.

16. The device as defined by claim 15 wherein said means for shifting the cutting arrangement comprises:

a cam member moved by said sensor pad;

a push arm assembly adapted to be connected to the cutting arrangement; and multiplier means operatively coupled to said cam member and said push arm assembly for varying the position of the cutting arrangement dependent upon the sensed blank thickness.

17. The device as defined by claim 16 wherein said sensor pad includes a cam surface beveled at an angle of 45° and said cam member includes a cam follower surface engaged by said cam surface, said cam follower surface being beveled at an angle of 45°.

18. The device as defined by claim 17 wherein said multiplier means comprises:

a bell crank pivotally mounted on said lower plate, said bell crank having arms of unequal length, said cam member being pivotally connected to the end of the short arm of said bell crank and said push arm assembly being pivotally connected to the end of the long arm of said bell crank.

19. The device as defined by claim 18 wherein the ratio of the length of said short arm to the length of said long arm is equal to the reciprocal of pi.

20. A method of cutting generally flat sheet stock to a particular size, comprising the steps of:

passing the stock between a pair of mutually spaced members;

sensing the thickness of said stock between said members;

positioning a cutting means relative to the stock between said members as a function of at least the said sensed thickness of the stock; and using said cutting means to cut the stock after the cutting means and stock have been so positioned relative to each other, to thereby produce a cut edge on the stock whose location is a function of the thickness of the stock.

21. The method defined in claim 20, including the step of gripping the stock and holding it in place while moving said cutting means to position the latter relative to the stock.

22. The method defined in claim 21, wherein said stock is gripped and held at least in part by using at least, certain of said mutually spaced members between which the stock is passed.

23. The method defined in claim 22, including the step of sensing the thickness of the stock while gripping and holding it.

24. The method defined in claim 23, including the step of using certain of said mutually spaced members to sense the thickness of said stock.

25. The method defined in claim 20, including the step of cutting a second edge on said stock at a predetermined distance relative to the previously recited cut edge and at substantially the same time the latter is cut.

* * * * *